US008928701B2

(12) United States Patent
Kim et al.

(10) Patent No.: US 8,928,701 B2
(45) Date of Patent: Jan. 6, 2015

(54) DISPLAY APPARATUS AND METHOD OF DRIVING THE SAME

(75) Inventors: Hyuk-Hwan Kim, Asan-si (KR); Seki Park, Asan-si (KR); Byoung Dae Ye, Yongin-si (KR); Dongmin Yeo, Asan-si (KR); Sang-Chul Byun, Anyang-si (KR)

(73) Assignee: Samsung Display Co., Ltd. (KR)

( * ) Notice: Subject to any disclaimer, the term of this patent is extended or adjusted under 35 U.S.C. 154(b) by 1184 days.

(21) Appl. No.: 12/840,382

(22) Filed: Jul. 21, 2010

(65) Prior Publication Data

US 2011/0069095 A1 Mar. 24, 2011

(30) Foreign Application Priority Data

Sep. 21, 2009 (KR) ..... 10-2009-0089126

(51) Int. Cl.
*G09G 5/10* (2006.01)
*G09G 3/36* (2006.01)
*G09G 3/34* (2006.01)

(52) U.S. Cl.
CPC ..... *G09G 3/342* (2013.01); *G09G 2360/16* (2013.01); *G09G 2330/06* (2013.01); *G09G 2320/064* (2013.01); *G09G 2320/0247* (2013.01)
USPC ..... 345/690

(58) Field of Classification Search
CPC ..... G09G 3/36; G09G 5/10; G06F 1/04; H05B 30/00; H05B 37/02; H05B 41/16
USPC ..... 345/102, 690, 691; 713/500–503, 713/600–601
See application file for complete search history.

(56) References Cited

U.S. PATENT DOCUMENTS

| | | | | |
|---|---|---|---|---|
| 4,736,444 | A * | 4/1988 | Dhein | 379/33 |
| 7,227,522 | B2 | 6/2007 | Fujimoto et al. | |
| 2007/0255974 | A1 * | 11/2007 | Gilday et al. | 713/503 |
| 2008/0117162 | A1 * | 5/2008 | Song et al. | 345/102 |
| 2009/0079688 | A1 * | 3/2009 | Chen et al. | 345/102 |
| 2010/0194792 | A1 * | 8/2010 | Lanchava et al. | 345/691 |
| 2011/0018912 | A1 * | 1/2011 | Adachi et al. | 345/690 |

FOREIGN PATENT DOCUMENTS

| | | |
|---|---|---|
| JP | 2002202760 | 7/2002 |
| KR | 1020020059240 | 7/2002 |
| KR | 1020080047875 | 5/2008 |
| KR | 1020080075647 | 8/2008 |

* cited by examiner

*Primary Examiner* — Tony N Ngo
(74) *Attorney, Agent, or Firm* — Cantor Colburn LLP

(57) ABSTRACT

A backlight driving circuit for a display apparatus includes a receiver, a signal modulation detector and a driver. The receiver receives a clock signal and a brightness data signal by a serial transmission and in response to an enable signal. The brightness data signal is synchronized with the clock signal and includes brightness information. The signal modulation detector detects a modulation of the brightness data signal, based on at least one of the clock signal and the enable signal, and outputs a control signal based on a detected result thereof. The driver receives the brightness data signal, in synchronization with the clock signal, selects one of the brightness data signal and a predetermined reference brightness data signal in response to the control signal, generates a driving voltage using the selected brightness data signal, and provides the driving voltage to the backlight unit to control the brightness of the backlight unit.

19 Claims, 7 Drawing Sheets

DISPLAY APPARATUS AND METHOD OF DRIVING THE SAME

This application claims priority to Korean Patent Application No. 10-2009-0089126 filed, on Sep. 21, 2009, and all the benefits accruing therefrom under 35 U.S.C. §119, the content of which in its entirety is herein incorporated by reference.

BACKGROUND OF THE INVENTION (1) Field of the Invention

The present invention relates to a display apparatus and a method of driving the display apparatus. More particularly, the present invention relates to a display apparatus that effectively prevents malfunctions caused by signal modulation due to static electricity, and a method of driving the display apparatus.

(2) Description of the Related Art

Light emitting diodes ("LEDs") are becoming increasingly popular for use as a light source of a backlight unit of a liquid crystal display ("LCD"), due to several advantages that LEDs provide over other light sources, such as cold cathode fluorescent lamps ("CCFLs"), for example.

When a backlight unit includes the light emitting diodes as a light source, the backlight unit is typically divided into light emitting groups for purposes of performing a dimming function in the backlight unit. More specifically, for local dimming, a liquid crystal display panel is divided into brightness control areas, and the light emitting groups are arranged in a one-to-one correspondence with the brightness control areas. Accordingly, a brightness of each light emitting group is controlled according to a gray-scale value of a corresponding brightness control area.

A brightness of each light emitting group is controlled according to a duty ratio of a driving voltage applied thereto. To control the duty ratio of the driving voltage, a backlight driving circuit receives a brightness control signal, which includes brightness information corresponding to the brightness control area, from an external device.

The backlight driving circuit receives the brightness control signal in series or, alternatively, in parallel. Generally, a required number of signal transmission lines is smaller for a serial transmission method than for a parallel transmission method. However, the serial transmission method is more vulnerable to static electricity than the parallel transmission method. Thus, there is a need to develop a backlight driving circuit that is capable of using serial transmission, but overcomes the above-mentioned deficiencies, e.g., vulnerability to static electricity, and the adverse affects resulting from the static electricity.

BRIEF SUMMARY OF THE INVENTION

Exemplary embodiments of the present invention provide a display apparatus that detects a signal that is modulated by static electricity to effectively prevent a malfunction of a backlight unit due to the static electricity modulating the signal.

Exemplary embodiments of the present invention also provide a method of driving the display apparatus.

According to one or more exemplary embodiments, a display apparatus includes a display panel that displays an image, a backlight unit that provides a light to the display panel, and a backlight driving circuit that drives the backlight unit. The backlight driving circuit includes a receiver, a signal modulation detector and a driver.

The receiver receives, by a serial transmission, a clock signal and a brightness data signal, which is synchronized with the clock signal and includes brightness information corresponding to a brightness of the backlight unit, in response to an enable signal. The signal modulation detector detects a modulation of the brightness data signal, based on at least one of the clock signal and the enable signal, and outputs a control signal based on a detected result of the detecting the modulation of the brightness data signal. The driver receives the brightness data signal, in synchronization with the clock signal, selects one of the brightness data signal and a predetermined reference brightness data signal in response to the control signal, generates a driving voltage using the selected brightness data signal, and provides the driving voltage to the backlight unit to control the brightness of the backlight unit.

According to one or more additional exemplary embodiments, a method of driving a display apparatus includes: receiving a clock signal and a brightness data signal by a serial transmission in response to an enable signal, the brightness data signal being synchronized with the clock signal and including brightness information corresponding to a brightness of the backlight unit; detecting a modulation of the brightness data signal based on at least one of the clock signal and the enable signal and outputting a control signal according to a detected result thereof; selecting one of the brightness data signal and a predetermined reference brightness data signal in response to the control signal; generating a driving voltage based on the selected brightness data signal and providing the driving voltage to the backlight unit to control the brightness of the backlight unit; generating a light in response to the driving voltage; and receiving the light from the backlight unit to display an image on the display apparatus.

According to the exemplary embodiments shown and described herein, a signal modulation detector detects a brightness data signal that has been modulated by static electricity based on a clock signal and an enable signal, which are simultaneously input with a brightness data signal, and outputs a control signal based on the detected result. Thus, the modulated brightness data signal is efficiently and accurately detected, and the signal modulation detector has a simplified circuit configuration. In addition, since the driving voltage provided to the backlight unit is controlled based on the control signal, a sharp increase or a sharp decrease of a brightness of the backlight unit, which is caused by the brightness data signal being modulated by the static electricity, is effectively prevented, thereby substantially improving a display quality of a display apparatus that includes the backlight unit.

BRIEF DESCRIPTION OF THE DRAWINGS

The above and other aspects and features of the present invention will become more readily apparent by describing in further detail exemplary embodiments thereof with reference to the accompanying drawings, in which.

DETAILED DESCRIPTION OF THE INVENTION

Figure 1:
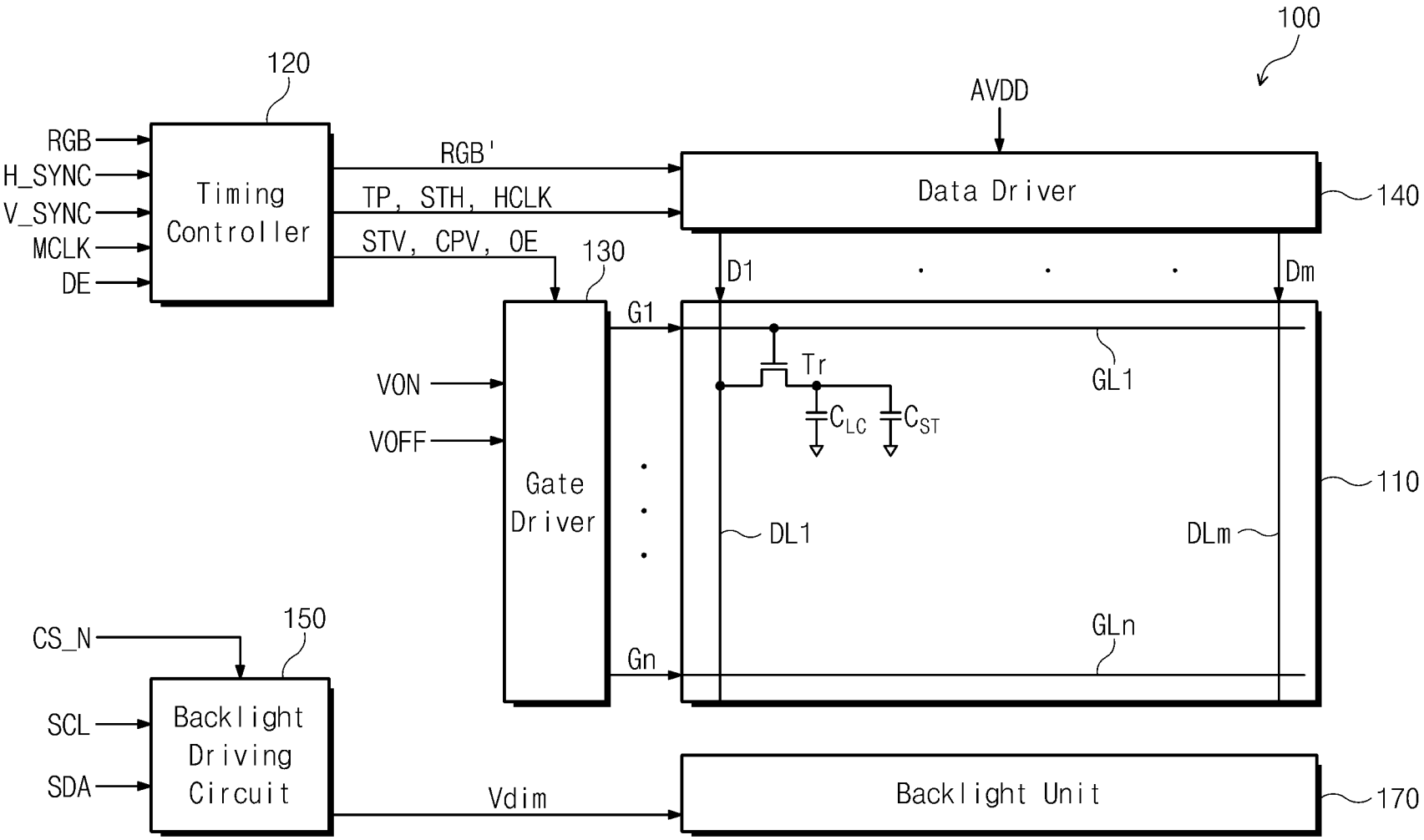
FIG. 1 is a block diagram of an exemplary embodiment of a display apparatus according to the present invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the present invention will be described in greater detail with reference to the accompanying drawings.

Figure 2:
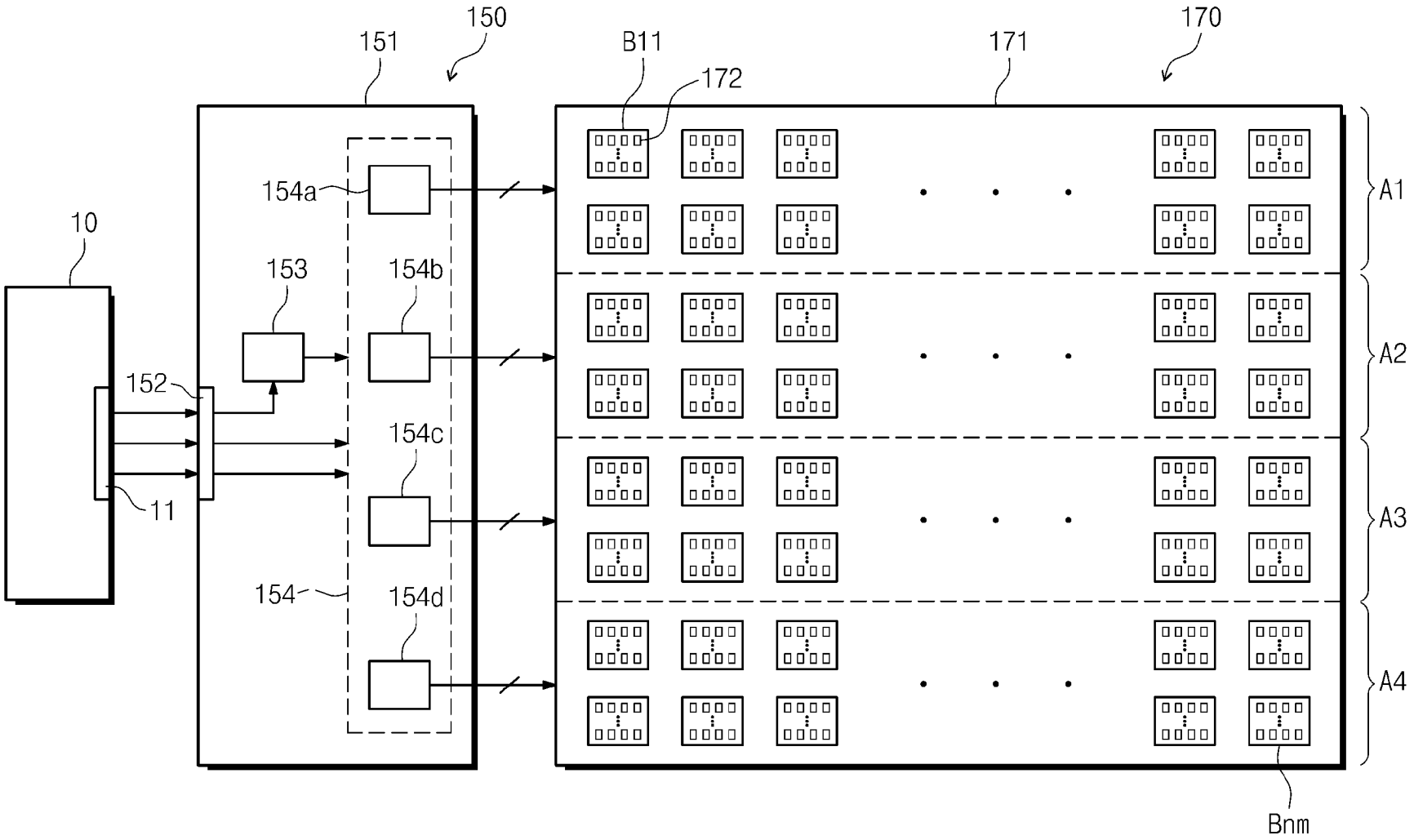
FIG. 2 is a block diagram of a backlight unit and a backlight driving circuit of the display apparatus shown in FIG. 1.

FIG. 1 is a block diagram of an exemplary embodiment of a display apparatus according to the present invention, and FIG. 2 is a block diagram of a backlight unit and a backlight driving circuit of the display apparatus shown in FIG. 1.

Referring to FIG. 1, a display apparatus, e.g., a liquid crystal display ("LCD") 100, according to one or more exemplary embodiments described and shown herein, includes a liquid crystal display panel 110, a timing controller 120, a gate driver 130, a data driver 140, a backlight driving circuit 150 and a backlight unit 170.

The liquid crystal display panel 110 includes gate lines GL1-GLn, data lines DL1-DLm, which are aligned substantially perpendicular to the gate lines GL1-GLn, and pixels. For purposes of description herein, one pixel has been shown in FIG. 1 as a representative example, but it will be noted that exemplary embodiments are not limited thereto. Each pixel includes a thin film transistor Tr having a gate electrode connected to a corresponding gate line GL, and a source electrode connected to a corresponding data line DL, a liquid crystal capacitor $C_{LC}$ connected to a drain electrode of the thin film transistor Tr, and a storage capacitor $C_{ST}$ connected to the liquid crystal capacitor $C_{LC}$ and connected in electrical parallel between ground and the liquid crystal capacitor $C_{LC}$, as shown in FIG. 1.

The timing controller 120 receives an image data signal RGB, a horizontal synchronization signal H_SYNC, a vertical synchronization signal V_SYNC, a main clock signal MCLK and a data enable signal DE from an external source (not shown). The timing controller 120 coverts a data format of the image data signal RGB into a format suitable for an interface of the data driver 140 and outputs a converted image data signal RGB' to the data driver 140. In addition, the timing controller 120 outputs data control signals, such as an output start signal TP, a horizontal start signal STH and a clock signal HCLK, for example, to the data driver 140, and outputs gate control signals, such as a vertical start signal STV, a gate clock signal CPV and an output enable signal OE, for example, to the gate driver 130.

The gate driver 130 receives a gate-on voltage Von and a gate-off voltage Voff and outputs gate signals G1-Gn, having the gate-on voltage Von, in response to the gate control signals STV, CPV and OE provided from the timing controller 120. The gate signals G1-Gn are sequentially applied to the gate lines GL1-GLn of the liquid crystal display panel 110 to sequentially scan the gate lines GL1-GLn. Although not shown in FIGS. 1 and 2, the LCD 100 according to an additional exemplary embodiment may further include a regulator that converts an input voltage to the gate-on voltage Von and the gate-off voltage Voff and outputs the gate-on voltage Von and the gate-off voltage Voff.

The data driver 140 operates in response to an analog driving voltage AVDD, and the data driver 140 generates gray-scale voltages using gamma voltages provided from a gamma voltage generator (not shown). The data driver 140 selects gray-scale voltages corresponding to the converted image data signal RGB' from among generated gray-scale voltages and in response to the data control signals TP, STH and HCLK provided from the timing controller 120, and supplies the selected gray-scale voltages to the data lines DL1-DLm of the liquid crystal display panel 110 as data signals D1-Dm.

As discussed above, the gate signals G1-Gn are sequentially applied to the gate lines GL1-GLn, and the data signals D1-Dm are applied to the data lines DL1-DLm. When a corresponding gate signal G is applied to a selected gate line GL, the thin film transistor Tr connected to the selected gate line GL is turned on in response to the corresponding gate signal G applied through the selected gate line GL. Thus, the data signal D that is applied to the data line DL connected to the turned-on thin film transistor Tr is charged to the liquid crystal capacitor $C_{LC}$ and the storage capacitor $C_{ST}$ through the turned-on thin film transistor Tr.

The liquid crystal capacitor $C_{LC}$ controls a light transmittance of a liquid crystal (not shown) according to the voltage charged thereto. The storage capacitor $C_{ST}$ stores the data signal D while the thin film transistor Tr is turned on, and applies the stored data signal D to the liquid crystal capacitor $C_{LC}$ while the thin film transistor Tr is turned off to maintain the charge of the liquid crystal capacitor $C_{LC}$. Through the above-described method, the liquid crystal display panel 110 displays a desired image thereon.

Still referring to FIGS. 1 and 2, the backlight unit 170 is disposed proximate to a rear side of the liquid crystal display panel 110, and provides light, having a desired brightness, to the liquid crystal display panel 110 in response to a driving voltage Vdim provided from the backlight driving circuit 150.

Dimming methods that control a brightness of the backlight unit 170 increase a contrast ratio of the image displayed on the liquid crystal display panel 110 and/or to reduce power consumption of the backlight unit 170. Specifically, for example, when the liquid crystal display 100 utilizes a local dimming method, the liquid crystal display panel 110 is divided into brightness control areas, and the backlight unit 170 includes light generating blocks B11-Bnm that correspond to the brightness control areas. In this case, the liquid crystal display 100 calculates a gray-scale value of the image displayed in each brightness control area and controls the brightness of the light exiting a corresponding light generating block B according to the calculated gray-scale value.

More particularly, when the gray-scale value of a given brightness control area is high (relative to other gray-scale values), the brightness of the light exiting from a corresponding light generating block B increases. Likewise, when the gray-scale value of a given brightness control area is relatively low, the brightness of the light exiting a corresponding light generating block decreases.

In the local dimming method, each of the light generating blocks B11-Bnm may include a light source (not shown) and, in an exemplary embodiment, the light source may be a light emitting diode ("LED") 172. In addition, LEDs 172 may be arranged in each of the light generating blocks B11-Bnm, and may be connected in electrical series with each other.

A number of the light generating blocks B11-Bnm may differ according to a size of the liquid crystal display panel 110, and a number of the LEDs 172 included in each of the light generating blocks B11-Bnm may differ according to a size of each light generating block B11-Bnm. The LEDs 172 in each of the light generating blocks B11-Bnm may be mounted on a first printed circuit board 171.

As shown in FIGS. 1 and 2, the backlight driving circuit 150 includes a receiver 152 connected to an external device 10, a signal modulation detector 153 that detects a modulation of a signal received at the receiver 152, and a driver 154 connected to the receiver 152 to receive the signal provided from the external device 10. The receiver 152, the signal modulation detector 153 and the driver 154 may be disposed on, e.g., mounted on, a second printed circuit board 151.

Figure 3:
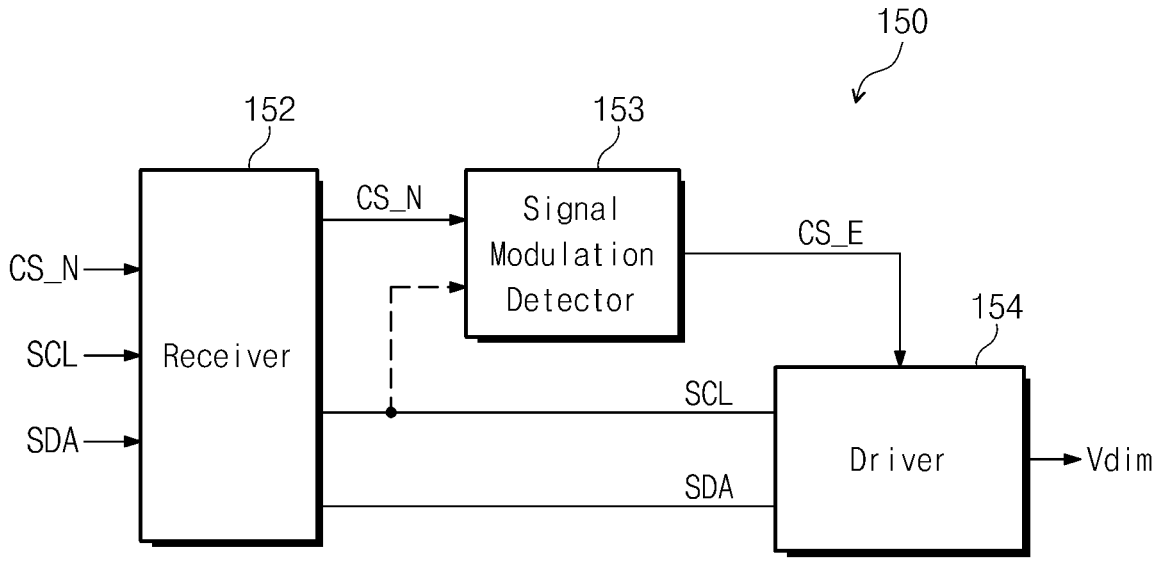
FIG. 3 is a block diagram of the backlight driving circuit of the display apparatus shown in FIG. 1.

FIG. 3 is a block diagram of the backlight driving circuit 150 of the display apparatus shown in FIG. 1.

Referring to FIGS. 2 and 3, the receiver 152 of the backlight driving circuit 150 receives, by a serial transmission, a clock signal SCL and a brightness data signal SDA that is synchronized with the clock signal SCL, from a transmitter 11 of the external device 10 in response to an enable signal CS_N. In one or more exemplary embodiments of the present invention, the receiver 152 may be a serial peripheral interface ("SPI"), although additional exemplary embodiments are not limited thereto.

The enable signal CS_N activates the receiver 152, and the receiver 152 receives the clock signal SCL and the brightness data signal SDA. When the receiver 152 is activated in response to the enable signal CS_N, the receiver 152 receives the brightness data signal SDA in synchronization with the clock signal SCL. The brightness data signal SDA includes brightness information that controls a brightness of the backlight unit 170.

Due to static electricity, the signals received through the receiver 152 may be modulated. Thus, in one or more exemplary embodiments, the signal modulation detector 153 detects the signal modulated by the static electricity. More specifically, for example, the signal modulation detector 153 receives the enable signal CS_N or the enable signal CS_N and the clock signal SCL from the receiver 152 to detect whether the brightness data signal SDA is modulated by the static electricity. When the brightness data signal SDA is modulated by the static electricity, the enable signal CS_N and the clock signal SCL, which as substantially simultaneously inputted with the brightness data signal SDA, are modulated. Thus, in an exemplary embodiment, the signal modulation detector 153 uses the enable signal CS_N or the clock signal SCL to detect whether the brightness data signal SDA is modulated.

The signal modulation detector 153 receives the enable signal CS_N and the clock signal SCL to detect the modulation of the brightness data signal SDA, caused by the static electricity, and outputs a control signal CS_E based on the detected result. The control signal CS_E outputted from the signal modulation detector 153 is provided to the driver 154.

The driver 154 receives the brightness data signal SDA in synchronization with the clock signal SCL, selects the brightness data signal SDA or a previous brightness data signal P_SDA (FIG. 8) in response to the control signal CS_E, and generates the driving voltage Vdim using the selected brightness data signal. The control signal CS_E may have a first state or a second state, depending on the detected result of the signal modulation. More specifically, in an exemplary embodiment, the control signal CS_E has the first state when the modulation of the signal does not occur, and the control signal CS_E has the second state when the modulation of the signal occurs.

When the control signal CS_E is in the first state, the driver 154 generates the driving voltage Vdim using the brightness data signal SDA provided from the receiver 152. However, when the control signal CS_E is in the second state, e.g., when the brightness data signal SDA is modulated by the static electricity, the driver 154 thereby generates the driving voltage Vdim based on a modulated brightness data signal SDA, the backlight unit 170 outputs light having a different brightness from that of the desired brightness. Thus, the driver 154 according to an exemplary embodiment generates the driving voltage Vdim using the previous brightness data signal P_SDA that was previously received before the brightness data signal SDA is received. Accordingly, the driving voltage Vdim, having the same voltage level as a previous driving voltage Vdim, is provided to the backlight unit 170, and a rapid and/or dramatic increase or decrease in brightness, due to the static electricity, is thereby effectively prevented.

The driver 154 may include one or more driver integrated circuits ("ICs"). As shown in FIG. 2, the driver 154 according to an exemplary embodiment includes four driver ICs 154*a*, 154*b*, 154*c* and 154*d*. The light generating blocks B11-Bnm of the backlight unit 170 may be divided into four light source units A1, A2, A3 and A4, which correspond to the four driver ICs 154*a*, 154*b*, 154*c* and 154*d*, respectively.

The brightness data signal SDA provided to the driver 154 includes address information of a corresponding driver IC. Thus, the brightness data signal SDA provided to the driver 154 may be applied to the corresponding driver IC according to the address information. The corresponding driver IC generates the driving voltage Vdim using the received brightness data signal SDA and provides the generated driving voltage Vdim to a corresponding light source unit of the backlight unit 170.

The driver ICs 154*a*-154*d* will be described in greater detail below with reference to FIG. 8.

Figure 4A:
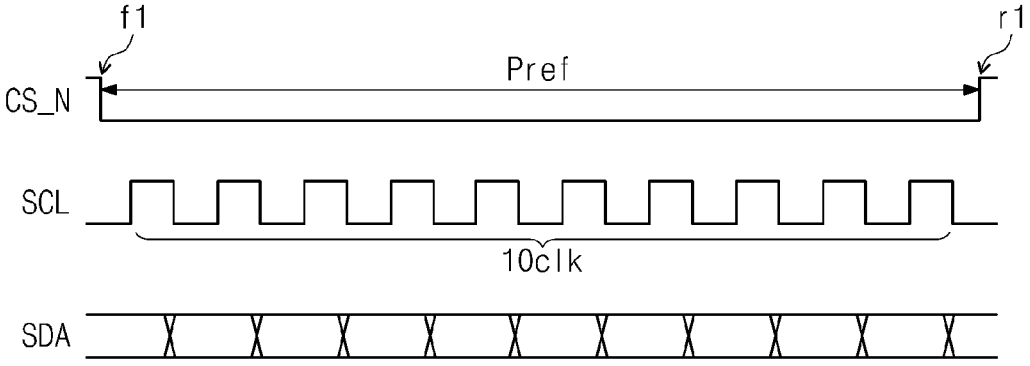
FIG. 4A is a signal timing diagram showing exemplary embodiments of an enable signal, a clock signal and a brightness data signal in a normal state.
Figure 4B:
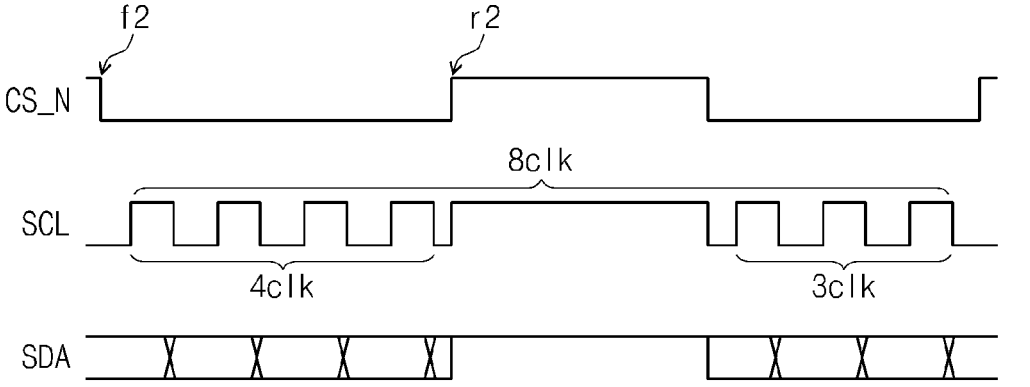
FIGS. 4B and 4C are signal timing diagrams showing examples of an enable signal, a clock signal and a brightness data signal, which are modulated by static electricity.
Figure 4C:
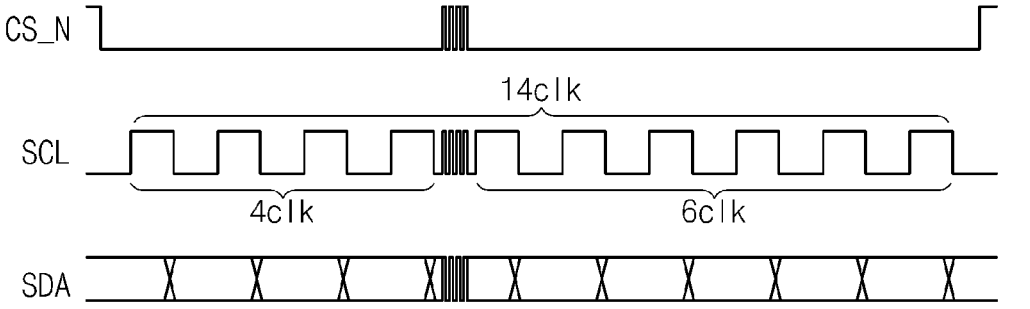

FIG. 4A is a signal timing diagram showing exemplary embodiments of an enable signal, a clock signal and a brightness data signal in a normal state, while FIGS. 4B and 4C are signal timing diagrams showing examples of an enable signal, a clock signal and a brightness data signal that are modulated by static electricity.

Referring to FIG. 4A, and assuming, for example, 10-bit data is transmitted, a clock signal SCL has ten high periods during an enable period Pref, which is a period defined from a first falling time point f1 to a first rising time point r1 of the enable signal CS_N in a normal state. The brightness data signal SDA includes 10-bit data indicating a state of 1 or 0.

However, when the brightness data signal SDA is modulated by the static electricity, a state of each bit of the brightness data signal SDA may be modulated, e.g., may be changed, from 1 to 0 or vice versa, as shown in FIG. 4B.

As also shown in FIG. 4B, when the brightness data signal SDA is modulated by the static electricity, the enable signal CS_N and the clock signal SCL are similarly modulated. Thus, in the example shown in FIGS. 4A and 4B, the modulated clock signal SCL has about eight high periods during the enable period Pref of the enable signal CS_N in the normal state, and the enable period of the modulated enable signal CS_N is shorter than the enable period Pref of the enable signal CS_N in the normal state.

As shown in FIG. 4C, when the brightness data signal SDA is modulated by the static electricity, the enable signal CS_N and the clock signal SCL are also modulated. Thus, when the brightness data signal SDA is modulated, the enable signal CS_N and the clock signal SCL are modulated, and, in an exemplary embodiment, the modulation of the brightness data signal SDA is detected by using the enable signal CS_N and the clock signal SCL.

Figure 5:
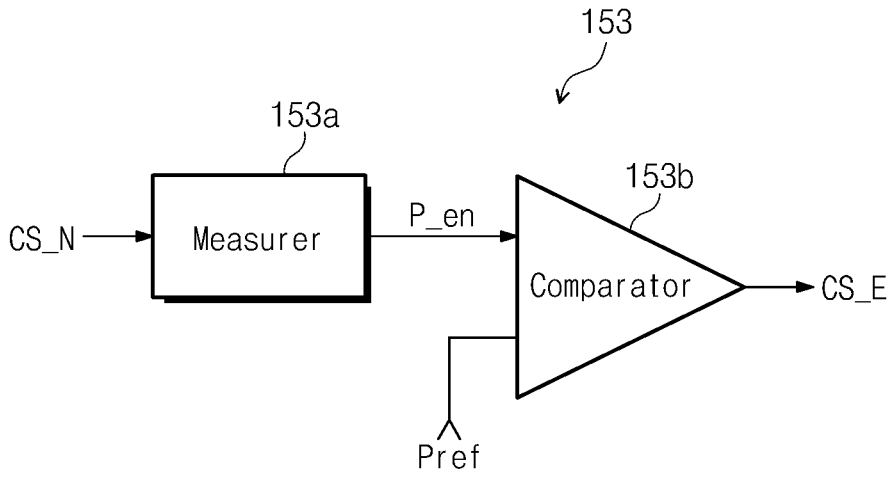
FIG. 5 is a block diagram showing an exemplary embodiment of a signal modulation detector according to the present invention.

FIG. 5 is a block diagram of an exemplary embodiment of a signal modulation detector according to the present invention.

Referring to FIG. 5, the signal modulation detector 153 includes a measurer 153*a* and a comparator 153*b*. The measurer 153*a* receives the enable signal CS_N from the receiver 152 to measure an enable period of the received enable signal CS_N. The comparator 153*b* compares the measured enable period P_en with an enable period (hereinafter, referred to as a "reference enable period Pref") of a predetermined normal enable signal. When the measured enable period P_en has a length equal to that of the reference enable period Pref, the comparator 153*b* outputs a control signal in a first state, e.g., indicating that there is no modulation. In contrast, when the measured enable period P_en has a length that is not equal to the reference enable period Pref, the comparator 153*b* outputs the control signal CS_E in a second state, indicating that modulation, due to static electricity, occurs.

The reference enable period Pref may be set to be a period defined from the first falling time point f1 to the first rising time point r1 of the normal enable signal CS_N, as shown in FIG. 4A.

As shown in FIG. 4B, if the received enable signal CS_N is modulated by the static electricity, the measured enable period P_en may be measured from a second falling time point f2 to a second rising time point r2.

Thus, the measured enable period P_en measured when the modulation of the signal occurs by the static electricity has a length, e.g., a duration, less than that of the reference enable period Pref. Accordingly, the comparator 153*b* outputs the control signal CS_E in the second state. Thus, the driver 154 detects that the signal is modulated by using the control signal CS_E in the second state.

Figure 6:
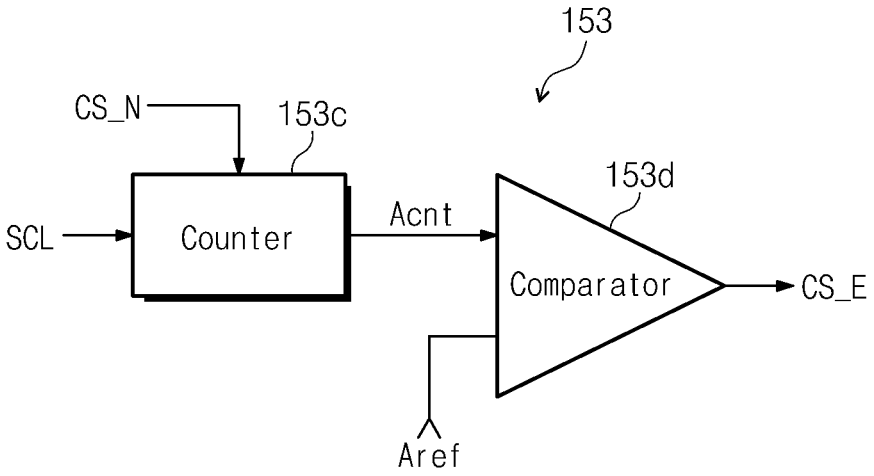
FIG. 6 is a block diagram showing an additional exemplary embodiment of a signal modulation detector according to the present invention.

FIG. 6 is a block diagram of an additional exemplary embodiment of a signal modulation detector according to the present invention.

Referring to FIG. 6, the signal modulation detector 153 includes a counter 153*c* and a comparator 153*d*. The counter 153*c* counts a clock signal SCL during a predetermined reference enable period Pref.

In one or more exemplary embodiments, the reference enable period Pref is set to be the enable period of the normal enable signal CS_N, e.g., the period defined from the first falling time point f1 to the first rising time point r1 of the normal enable signal CS_N, as shown in FIG. 4A.

The counter 153*c* counts the number of high periods of the clock signal SCL during the reference enable period Pref and provides a counted value Acnt to the comparator 153*d*. As shown in FIG. 4B, when the clock signal SCL is modulated by the static electricity, the counter 153*c* outputs the counted value Acnt of 8 during the reference enable period Pref.

The comparator 153*d* compares the counted value Acnt with a predetermined reference value Aref to output a control signal CS_E based on the compared result. In an exemplary embodiment, when data of 10-bit is transmitted, the reference value Aref may be set to 10. In this case, if the comparator 153*d* receives the counted value Acnt of 8, the comparator 153*d* outputs the control signal CS_E in a second state, since the counted value Acnt is less than the reference value Aref. Therefore, the driver 154 detects the modulation of the signal based on the control signal CS_E in the second state.

In another exemplary embodiment, the reference enable period Pref may be set to be the enable period of the received enable signal CS_N. Thus, as shown in FIG. 4B, when the enable signal CS_N is modulated by the static electricity, the reference enable period Pref may be set from the second falling time point f2 to the second rising time point r2.

As shown in FIG. 4B, when the clock signal SCL is modulated by the static electricity, the counter 153*c* outputs the counted value Acnt of 4 during the reference enable period Pref. Accordingly, since the reference value Aref is set to 10, the comparator 153*d* outputs the control signal CS_E in the second state. Consequently, the driver 154 detects the modulation of the signal according to the control signal CS_E in the second state.

Figure 7:
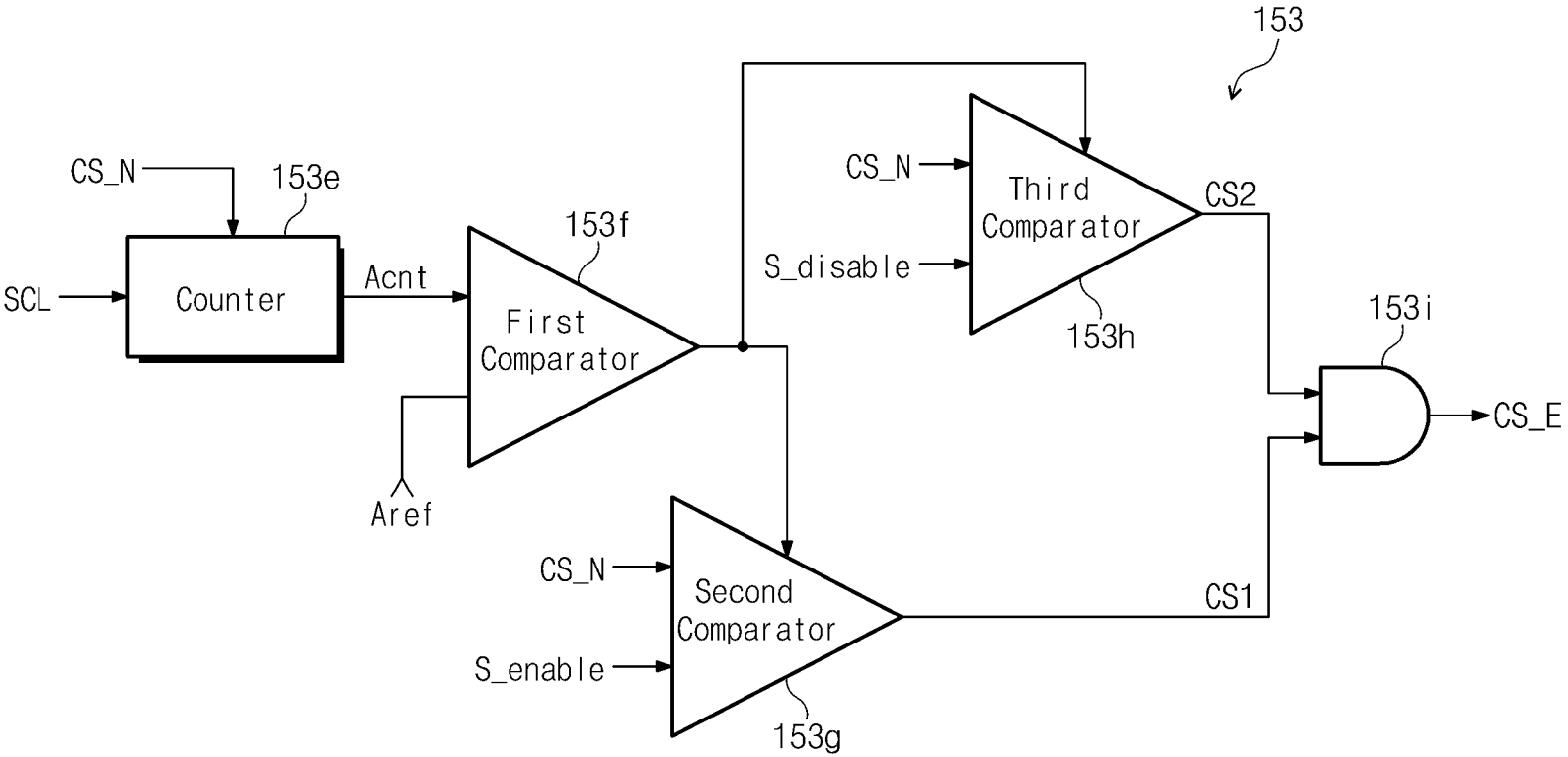
FIG. 7 is a block diagram showing another exemplary embodiment of a signal modulation detector according to the present invention.

FIG. 7 is a block diagram showing another additional exemplary embodiment of a signal modulation detector according to the present invention.

Referring to FIG. 7, a signal modulation detector 153 includes a counter 153*e*, a first comparator 153*f*, a second comparator 153*g*, a third comparator 153*h* and a logic AND gate 153*i*.

The counter 153*e* counts the clock signal SCL from a time point of the enable signal CS_N, at which the enable signal CS_N becomes enabled. The counted value Acnt is provided to the first comparator 153*f*, and the first comparator 153*f* compares the counted value Acnt with a predetermined reference value Aref. If the counted value Acnt is less than or equal to the reference value Aref, the second comparator 153*g* is activated. In contrast, if the counted value Acnt is greater than the reference value Aref, the third comparator 153*h* is activated.

The second comparator 153*g* determines whether the enable signal CS_N is maintained at an enable state S_enable until the counted value Acnt is equal to the reference value Aref. When the enable signal CS_N is maintained at the enable state S_enable, the second comparator 153*g* outputs a first comparison signal CS1 in a first state.

When the counted value Acnt is greater than the reference value Aref, the third comparator 153*h* determines whether the enable signal CS_N is maintained at a disable state S_disable during a predetermined number of clocks. When the enable signal CS_N is maintained at the disable state S_disable during the predetermined number of clocks, the third comparator 153*h* outputs a second comparison signal CS2 in a first state.

The AND gate 153*i* outputs a control signal CS_E in a first state when the first and second comparison signals CS1 and CS2, respectively, outputted from the second and third comparators 153*g* and 153*h*, respectively, are in the first state. Accordingly, the driver 154 determines that the modulation of the signal does not occur while the driver 154 receives the control signal CS_E in the first state from the signal modulation detector 153.

If at least one signal (of the first and second comparison signals CS1 and CS2, respectively) is in the second state, the AND gate 153*i* outputs the control signal CS_E in a second state. Thus, the driver 154 determines that the modulation of the signal occurs when the driver 154 receives the control signal CS_E in the second state from the signal modulation detector 153.

It will be noted that, while various structures of the signal modulation detector 153 have been described herein, that additional exemplary embodiments of the present invention are not be limited thereto or thereby. Instead, the structure of the signal modulation detector 153 may be embodied in many different ways, as long as the modulation of the brightness data signal SDA is detected based on the enable signal CS_N and the clock signal SCL.

In addition, as shown in FIG. 2, the signal modulation detector 153 may be formed as a separate member from the driver 154 and mounted on the second printed circuit board 151. Further, the signal modulation detector 153 may be disposed in each of the driver ICs 154*a*-154*d* disposed in the driver 154.

As shown in FIGS. 5 through 7, since the signal modulation detector 153 detects the modulation of the brightness data signal SDA using the enable signal CS_N and the clock signal SCL modulated with the brightness data signal SDA, the modulation of the signal, caused by the static electricity, is efficiently and accurately detected. In addition, since the signal modulation detector 153 is formed with a relatively simple circuit configuration, additional circuitry is not required.

Figure 8:
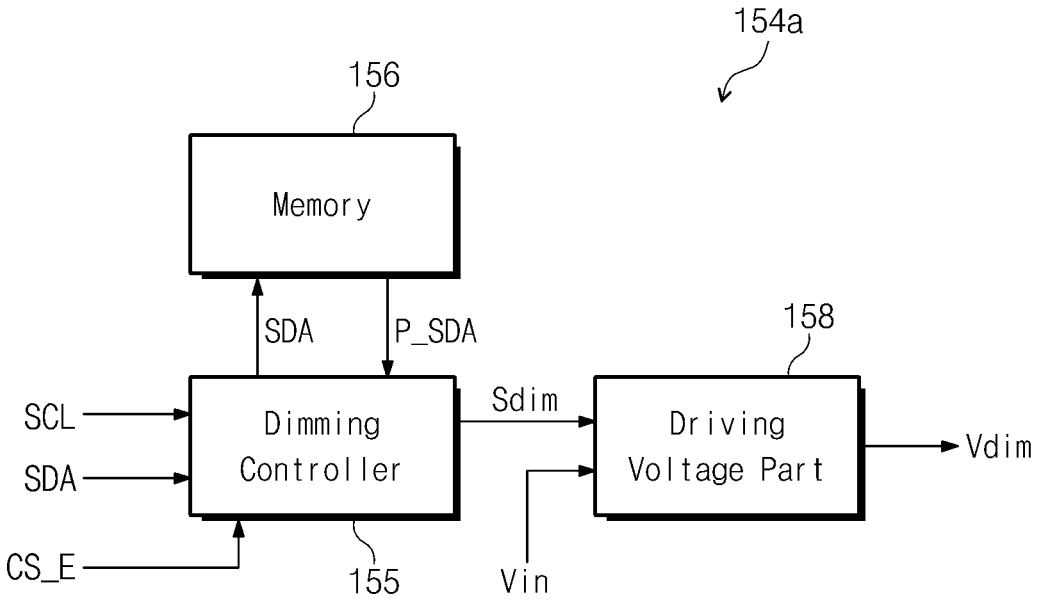
FIG. 8 is a block diagram of an exemplary embodiment of a driver integrated circuit according to the present invention.

FIG. 8 is a block diagram of an exemplary embodiment of a driver IC according to the present invention. The driver 154 includes the driver ICs 154*a*-154*d* (FIG. 2); however, since the driver ICs 154*a*-154*d* have substantially the same structure and function, the structure of only one driver IC has been shown in FIG. 8 as a representative example, but it will be noted that additional exemplary embodiments are not limited thereto.

Referring to FIG. 8, the driver IC 154*a* includes a dimming controller 155, a memory 156 and a driving voltage part 158.

The dimming controller 155 receives the brightness data signal SDA in synchronization with the clock signal SCL and generates a dimming signal Sdim, a voltage level of which is varied according to the received brightness data signal SDA. The dimming controller 155 sequentially stores temporally received brightness data signals SDA in the memory 156. Also, the dimming controller 155 receives the control signal CS_E from the signal modulation detector 153.

When the received control signal CS_E has the first state, the dimming controller 155 determines that the received brightness data signal SDA is not modulated, and generates the dimming signal Sdim based on the received brightness data signal SDA, e.g., based on the current brightness data signal SDA.

In contrast, when the control signal CS_E has the second state, the dimming controller 155 determines that the received brightness data signal SDA is modulated (e.g., by static electricity) and reads out a previous brightness data signal P_SDA that was previously stored in the memory 156 (before the current brightness data signal SDA), instead of the current (received) brightness data signal SDA to generate the dimming signal Sdim based on the read-out previous brightness data signal P_SDA.

The driving voltage part 158 generates the driving voltage Vdim, which has a pulse width that varies according to the dimming signal Sdim. More particularly, the driving voltage part 158 generates the driving voltage Vdim for operation of the backlight unit 170 (FIG. 2) using a predetermined input voltage Vin and changes the pulse width of the driving voltage Vdim according to the dimming signal Sdim to provide the driving voltage Vdim to the backlight unit 170.

In an additional exemplary embodiment, the driving voltage part 158 may include a DC-DC converter (not shown) that boosts the input voltage Vin to output the driving voltage Vdim, and a pulse-width modulator (not shown) that modulates the boosted driving voltage Vdim to allow the driving voltage Vdim to have a duty ratio suitable for a dimming operation of the backlight unit 170. Thus, the pulse-width modulator controls the duty ratio of the driving voltage Vdim in response to the dimming signal Vdim. The DC/DC converter may be disposed outside the driver IC 154*a*.

In an exemplary embodiment, the dimming controller 155 may include a digital variable resistor (not shown). The digital variable resistor may generate the dimming signal Sdim that varies in value by about 128 steps or, alternatively, by about 256 steps, within a range from about 0 volts (V) to about 3.3 V, according to a gray-scale of each pixel of the liquid crystal display panel 110. Thus, the pulse width of the driving voltage Vdim, generated by the driving voltage part 158, may vary in value by about 128 steps or, alternatively, by about 256 steps, based on the dimming signal Sdim.

When the received control signal CS_E has the first state, the dimming controller 155 generates the dimming signal Sdim based on the received (e.g., current) brightness data signal SDA, and the driving voltage part 158 controls the duty ratio of the driving voltage Vdim in response to the dimming signal Sdim. In contrast, when the received control signal CS_E has the second state, the dimming controller 155 generates the dimming signal Sdim based on the previous brightness data signal P_SDA, and the driving voltage part 158 controls the duty ratio of the driving voltage Vdim in response to the dimming signal Sdim.

As a result, even though the brightness data signal SDA is modulated by the static electricity, the backlight unit 170 according to one or more exemplary embodiments described herein is operated in response to the driving voltage Vdim based on the previous dimming signal P_Sdim, thereby effectively preventing a sharp increase or decrease in brightness of the backlight unit 170.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A display apparatus comprising:

a display panel which displays an image;

a backlight unit which provides a light to the display panel; and a backlight driving circuit which drives the backlight unit, wherein the backlight driving circuit comprises:

a receiver which receives a clock signal and a brightness data signal by a serial transmission in response to an enable signal, the brightness data signal synchronized with the clock signal and including brightness information controlling a brightness of the backlight unit;

a signal modulation detector which detects a modulation of the brightness data signal by a static electricity, based on at least one of the clock signal and the enable signal, and outputs a control signal based on a detected result thereof; and a driver which receives the brightness data signal, in synchronization with the clock signal, selects one of the brightness data signal and a predetermined reference brightness data signal in response to the control signal, generates a driving voltage using the selected brightness data signal, and provides the driving voltage to the backlight unit to control the brightness of the backlight unit, wherein the control signal has a first state when the brightness data signal is not modulated by a static electricity, and the control signal has a second state when the brightness data signal is modulated by the static electricity.

2. The display apparatus of claim 1, wherein the signal modulation detector comprises:

a measurer which measures an enable period of the enable signal to generate a measured enable period; and a comparator which compares the measured enable period with an enable period of a normal enable signal and outputs the control signal based on a compared result thereof.

3. The display apparatus of claim 1, wherein the signal modulation detector comprises:

a counter which counts the clock signal during a reference period to generate a counted value; and a comparator which compares the counted value with a predetermined reference value and outputs the control signal based on a compared result thereof.

4. The display apparatus of claim 3, wherein the reference period is defined as a period from a first falling time point of the enable signal to a first rising time point of the enable signal.

5. The display apparatus of claim 3, wherein the reference period is defined as a period from an enable start time point of the enable signal to an enable end time point of the enable signal.

6. The display apparatus of claim 1, wherein the signal modulation detector comprises:

a counter which counts the clock signal from an enable start time point of the enable signal to generate a counted value;

a first comparator which compares the counted value with a predetermined reference value;

a second comparator which is activated when the counted value is less than or equal to the predetermined reference value to determine whether the enable signal is maintained at an enable state until the counted value is equal to the reference value;

a third comparator which is activated when the counted value is greater than the predetermined reference value to determine whether the enable signal is maintained at a disable state during a predetermined number of clocks; and an AND gate which combines checked results of the second comparator and the third comparator and outputs a combined result thereof as the control signal.

7. The display apparatus of claim 1, wherein the driver comprises:

a dimming controller which selects one of the brightness data signal and the reference brightness data signal in response to the control signal and generates a dimming signal based on the selected brightness data signal;

a memory which sequentially stores the brightness data signal received from the dimming controller; and a driving voltage part which converts an input voltage to the driving voltage and controls a duty ratio of the driving voltage based on the dimming signal.

8. The display apparatus of claim 7, wherein the dimming controller generates the dimming signal based on the brightness data signal, received from the receiver, when the control signal is in a first state, and the dimming controller generates the dimming signal based on a previous brightness data signal, stored in the memory, as the reference brightness data signal when the control signal is in a second state.

9. The display apparatus of claim 8, wherein the driving voltage part controls the duty ratio of the driving voltage based on the previous brightness data signal when the control signal is in the second state.

10. The display apparatus of claim 1, wherein the display panel is divided into brightness control areas, the backlight unit comprises light emitting groups corresponding to the brightness control areas, and each light emitting group of the light emitting groups comprises light emitting diodes connected in electrical series with each other.

11. A method of driving a display apparatus, the method comprising:

receiving a clock signal and a brightness data signal by a serial transmission in response to an enable signal, the brightness data signal being synchronized with the clock signal and including brightness information controlling a brightness of the backlight unit;

detecting a modulation of the brightness data signal by a static electricity based on at least one of the clock signal and the enable signal and outputting a control signal according to a detected result thereof;

selecting one of the brightness data signal and a predetermined reference brightness data signal in response to the control signal;

generating a driving voltage based on the selected brightness data signal and providing the driving voltage to the backlight unit to control the brightness of the backlight unit;

generating a light in response to the driving voltage; and receiving the light from the backlight unit to display an image on the display apparatus, wherein the control signal has a first state when the brightness data signal is not modulated by a static electricity, and the control signal has a second state when the brightness data signal is modulated by the static electricity.

12. The method of claim 11, wherein the detecting the modulation of the brightness data signal comprises:

measuring an enable period of the enable signal to generate a measured enable period; and comparing the measured enable period with an enable period of a normal enable signal and outputting the control signal based on compared result thereof.

13. The method of claim 11, wherein the detecting the modulation of the signal comprises:

counting the clock signal during a predetermined reference period to generate a counted value; and comparing the counted value with a predetermined reference value and outputting the control signal based on a compared result thereof.

14. The method of claim 13, wherein the reference period is defined as a period from a first falling time point of the enable signal to a first rising time point of the enable signal.

15. The method of claim 13, wherein the reference period is defined as a period from an enable start time point of the enable signal to an enable end time point of the enable signal.

16. The method of claim 11, wherein the detecting the modulation of the brightness data signal comprises:

counting the clock signal from an enable start time point of the enable signal to generate a counted value based thereon;

comparing the counted value with a predetermined reference value;

determining whether the enable signal is maintained at an enable state until the counted value is equal to the reference value;

determining whether the enable signal is maintained at a disable state during a predetermined number of clocks when the counted value is greater than the reference value; and combining checked results of the determining whether the enable signal is maintained at the enable state until the counted value is equal to the reference value and the determining whether the enable signal is maintained at the disable state during the predetermined number of clocks when the counted value is greater than the reference value to generate combined results; and outputting the combined results as the control signal.

17. The method of claim 11, wherein the generating the driving voltage comprises:

selecting one of the brightness data signal and the reference brightness data signal in response to the control signal and generating a dimming signal based on a selected brightness data signal therefrom;

sequentially storing temporally adjacent brightness data; and converting an input voltage into the driving voltage and controlling a duty ratio of the driving voltage based on the dimming signal.

18. The method of claim 17, wherein the generating the dimming signal comprises:

generating the dimming signal based on the received brightness data signal when the control signal is in a first state; and generating the dimming signal based on a previous brightness data signal when the control signal is in a second state.

19. The method of claim 18, wherein the controlling the duty ratio of the driving voltage comprises controlling the duty ratio of the driving voltage based on the dimming signal based on the previous brightness data signal when the control signal is in the second state.

* * * * *